US005195452A

United States Patent [19]

Kamiya

[11] Patent Number: 5,195,452

[45] Date of Patent: Mar. 23, 1993

[54] SEWING MACHINE PROVIDED WITH A THREADING DEVICE FOR THREADING A PLURALITY OF NEEDLES

[75] Inventor: Osamu Kamiya, Chiryu, Japan

[73] Assignee: Brother Kogyo Kabushiki Kaisha, Nagoya, Japan

[21] Appl. No.: 874,091

[22] Filed: Apr. 27, 1992

[30] Foreign Application Priority Data

Jul. 2, 1991 [JP] Japan ..... 3-188198

[51] Int. Cl.[5] ..... D05B 87/02

[52] U.S. Cl. ..... 112/225

[58] Field of Search ..... 112/225, 302, 163

[56] References Cited

U.S. PATENT DOCUMENTS

| | | | |
|---|---|---|---|
| 4,893,573 | 1/1990 | Moriya | 112/225 |
| 5,072,678 | 12/1991 | Satoma | 112/225 |
| 5,143,005 | 9/1992 | Jimenez | 112/225 |

FOREIGN PATENT DOCUMENTS

| | | | |
|---|---|---|---|
| 53-35061 | 8/1978 | Japan . | |
| 3133483 | 6/1991 | Japan | 112/225 |

*Primary Examiner*—Andrew M. Falik
*Assistant Examiner*—Paul C. Lewis
*Attorney, Agent, or Firm*—Oliff & Berridge

[57] ABSTRACT

A multineedle sewing machine is provided with a needle bar and a threading bar supported for turning about its axis and for vertical movement in parallel to the needle bar fixedly provided at its lower end with a hook holding member. A threading hook member is supported on the hook holding member so as to be movable in directions perpendicular to the axis of the threading bar in a plane. The position of the threading hook member relative to the threading bar can be changed by turning a lever. A positioning cam having a cam surface provided with positioning recesses is provided for turning on the threading bar near the upper end of the same, and a pin fixed to the threading bar is in egagement with the cam surface of the positioning cam. When the lever is turned, the positioning cam is turned to determine the vertical position of the threading bar selectively and, at the same time, a radius changing lever is turned to change the radius of turning of the threading hook member.

20 Claims, 12 Drawing Sheets

SEWING MACHINE PROVIDED WITH A THREADING DEVICE FOR THREADING A PLURALITY OF NEEDLES

BACKGROUND OF THE INVENTION

1. Field of the Invention

The present invention relates to a sewing machine having a plurality of needles and being provided with a threading the device for threading the plurality of needles thereof.

2. Description of the Related Art

A conventional lock stitch sewing machine is provided with a needle bar holding a plurality of needles. Typically, a pincette has been used in manually threading the needles of such a lock stitch sewing machine. A method of manually threading needles using a threading attachment is disclosed in Japanese Utility Model Publication No. Sho 53-35061.

However, a threading operation using a pincette or a threading attachment is often obstructed by a looper and an edge trimmer disposed in front of the needles, which makes threading difficult.

On the other hand, a sewing machine having a needle bar holding a single needle is provided with a threading hook supported for turning in a vertical plane so as to be advanced into and retracted from the eye of the needle. When the threading hook is advanced into the eye of the needle, the needle thread is hooked by the threading hook and is passed through the eye of the needle when the threading hook is retracted. Since the threading hook only needs to be turned for threading the needle, the threading hook facilitates threading. Hence, a threading operation using the threading hook is easier than a threading operation using a pincette or a threading attachment.

Accordingly, it has been desired to provide a lock stitch sewing machine having a needle bar holding a plurality of needles with a threading hook to facilitate threading the plurality of needles.

SUMMARY OF THE INVENTION

An object of the present invention is to provide a threading device for a sewing machine having a needle bar holding a plurality of needles capable of facilitating threading the plurality of needles.

A sewing machine provided with a threading device in accordance with the present invention comprises a needle bar holding a plurality of needles, a threading bar supported for vertical reciprocation in parallel to the needle bar, a threading hook provided on the threading bar so as to be advanced into and retracted from the eye of the needle as the threading bar turns about its axis, and level selecting means rotatably supported on the threading bar to locate the threading hook selectively on a level corresponding to the level of the eye of a desired needle among the plurality of needles. The sewing machine may be provided additionally with radius selecting means for selectively determining a radius of a circular path along which the threading hook turns so that the threading hook corresponds to a desired needle among the plurality of needles.

In a three-needle lock stitch sewing machine provided with three needles, the three needles are held so that the respective points, hence the respective eyes, of the three needles are on different levels. Accordingly, the level on which the threading hook is turned must be changed selectively so that the threading hook coincides with the eye of a desired needle among the three needles to advance the threading hook into and to retract the same from the eye of the desired needle by turning the threading hook.

According to the present invention, the level selecting means turns to locate the threading hook on a level corresponding to the level of a selected needle among the plurality of needles in threading the selected needle. Then, the threading hook is turned to advance the threading hook into the eye of the selected needle for threading. Thus, the threading device enables threading simply by turning the threading hook, which simplifies threading operation as compared with threading operation requiring a pincette or a threading attachment.

In the threading device of the present invention, the threading hook is turned about the axis of the threading bar, the radius of a circular path along which the threading hook is turned must be changed according to the position of the needle when the plurality of needles are arranged laterally.

The present invention changes the radius of a circular path along which the threading hook is turned by the radius selecting means so that the threading hook corresponds to a desired needle among the plurality of needles. Therefore, the threading device of the present invention is applicable to a sewing machine having a plurality of needles held in a lateral arrangement.

Threading operation of the sewing machine of the present invention requiring only turning the threading hook for threading is simpler than the threading operation of the sewing machine using a pincette or a threading attachment.

Since the sewing machine of the present invention is provided with the radius selecting means for changing the radius of a circular path along which the threading hook is turned so that the threading hook corresponds to one of the plurality of needles, the plurality of needles can be threaded by the threading hook even if the needles require changing the radius of a circular path along which the threading hook is turned.

BRIEF DESCRIPTION OF THE DRAWINGS

Preferred embodiments of the present invention will be described in detail with reference to the accompanying drawings, in which.

DETAILED DESCRIPTION OF THE PREFERRED EMBODIMENTS

The present invention will be described hereinafter as applied to a three-needle lock stitch sewing machine.

Figure 1:
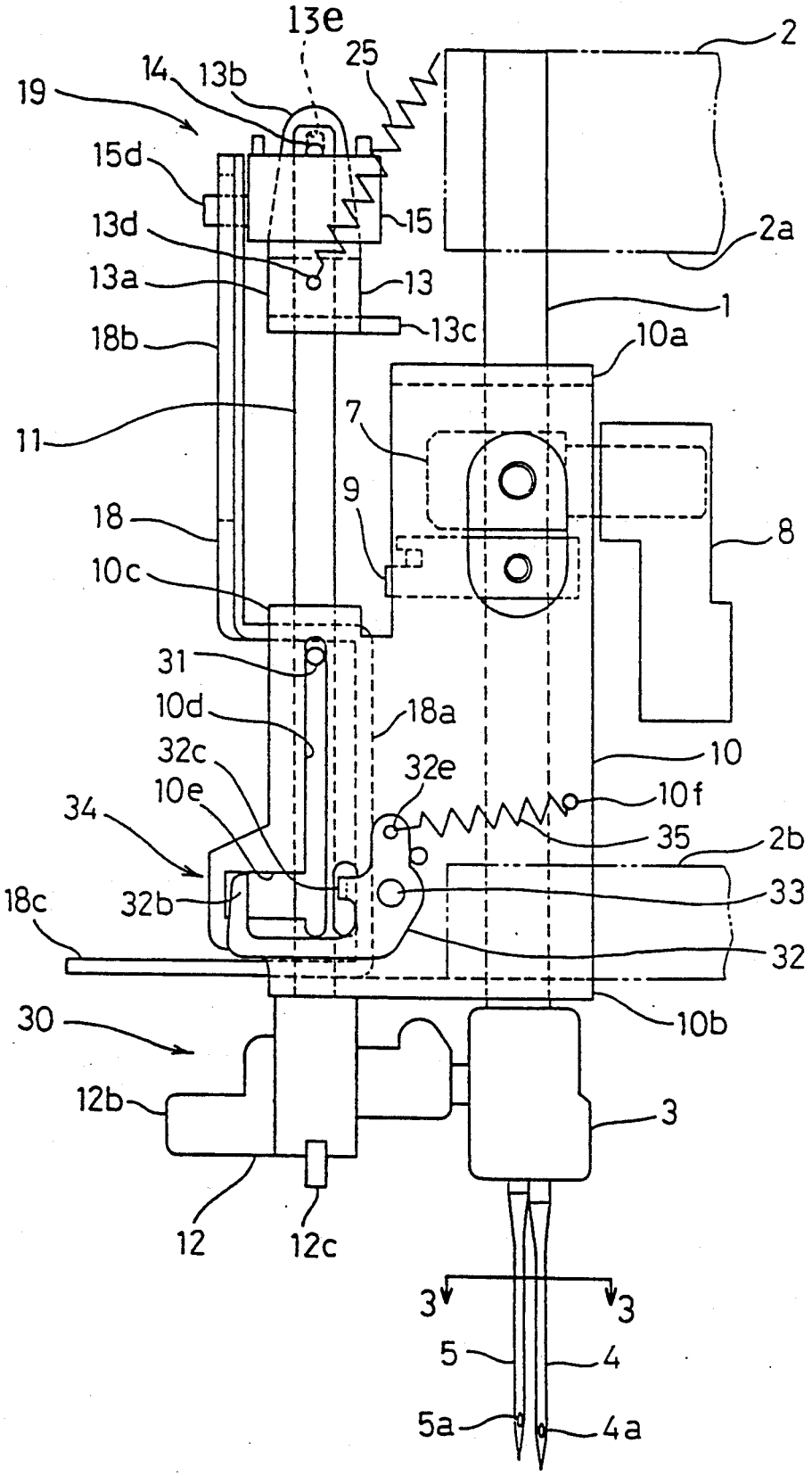
FIG. 1 is a partial front view of a sewing machine in a preferred embodiment according to the present invention, showing a threading device and the associated parts.
Figure 2:
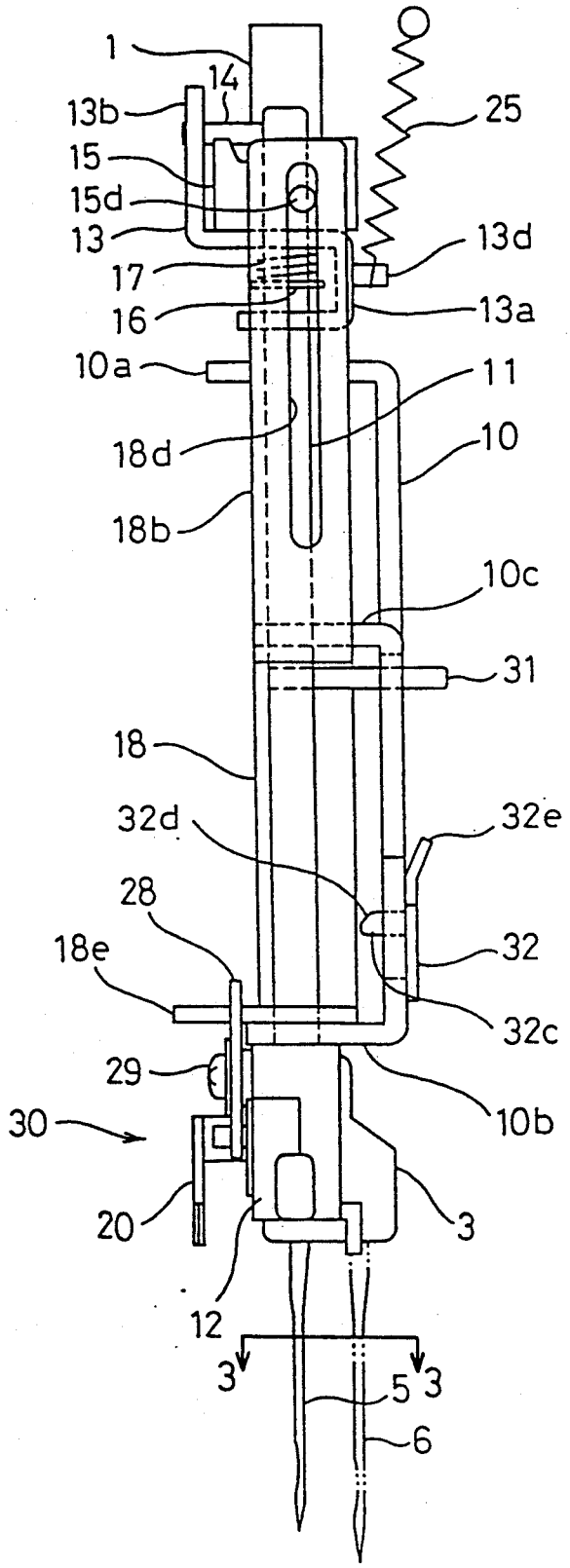
FIG. 2 is a side view of the threading device and the associated parts of FIG. 1.

Referring to FIGS. 1 and 2, a needle bar is supported for vertical reciprocation by support members 2*a* and 2*b* on a main body 2. The main body 2 consists of a bed, not shown, and an arm, not shown. The needle bar 1 is provided at its lower end with a needle holder 3 capable of holding three needles 4, 5 and 6.

Figure 3:
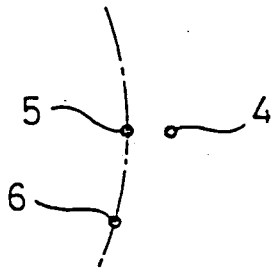
FIG. 3 is a cross-sectional view of the needles taken through line 3—3 of FIGS. 1 and 2 showing the respective positions of needles.
Figure 4:
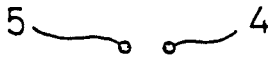
FIG. 4 is a cross-sectional view showing an arrangement of needles according to a lock stitch arrangement of the machine shown in FIG. 1.
Figure 5:
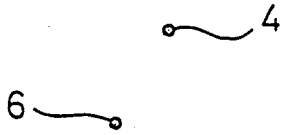
FIG. 5 is a cross-sectional view showing another arrangement of needles according to a lock stitch arrangement of the machine shown in FIG. 20.

As shown in FIG. 3, the needles 4 and 5 are arranged laterally, and the needles 5 and 6 are arranged longitudinally. The lock stitch sewing machine uses the needles 4 and 5 in an arrangement shown in FIGS. 1 and 4 or the needles 4 and 6 in an arrangement shown in FIGS. 5 and 20. The lock stitch sewing machine never uses all the three needles 4, 5 and 6 simultaneously.

Figure 20:
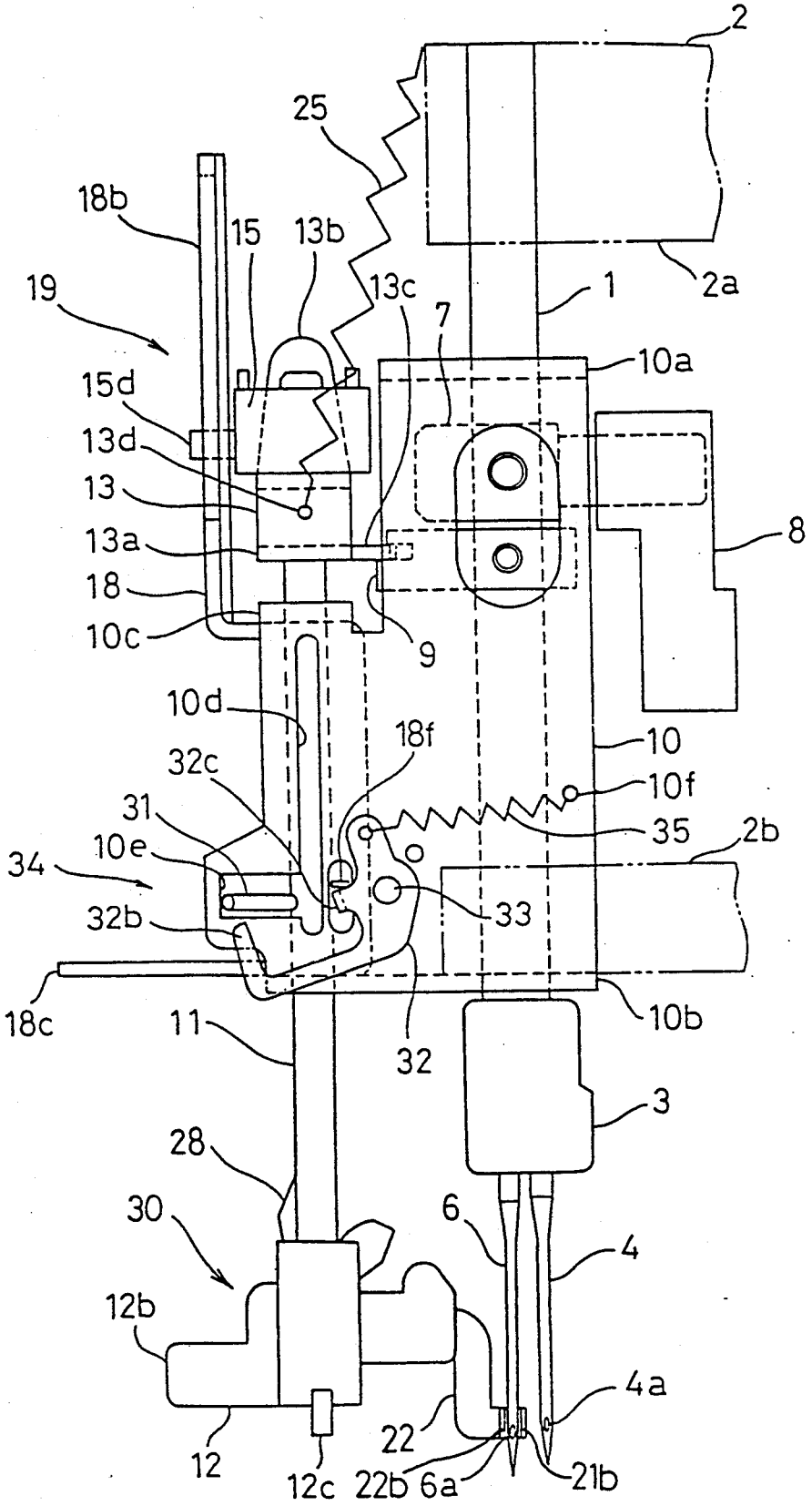
FIG. 20 is a partial front view, similar to FIG. 1, of the threading device, in which the threading bar is at its lower position.

The needles 4, 5 and 6 are held so that their points, hence their eyes 4*a*, 5*a* and 6*a*, are on different levels. As shown in FIGS. 1 and 20, the needle 5 is held at the highest level, the needle 4 is held at the middle level and the needle 6 is held at the lowest level.

Figure 6:
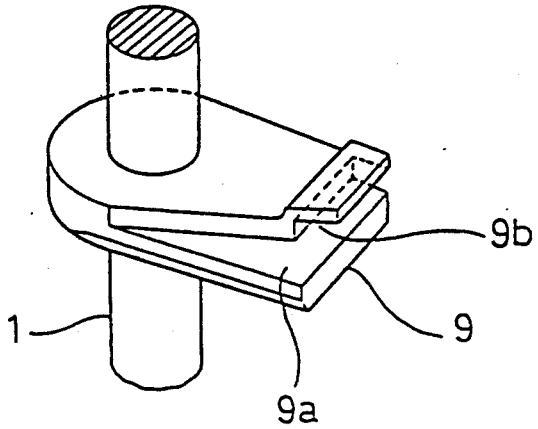
FIG. 6 is a partial perspective view of a positioning member.

As shown in FIGS. 1 and 20, a needle bar holding member 7 connected to a linkage 8 is fastened to the middle portion of the needle bar 1. The driving force of a main motor, not shown, is transmitted through an upper shaft, not shown, a crank mechanism, not shown, and the linkage 8 to the needle bar holding member 7 to reciprocate the needle bar vertically. A stopping member 9 is fixed to the needle bar 1 at a position under the needle bar holding member 7. As shown in FIG. 6, the stopping member 9 has a stopping part 9*a* and a groove 9*b* on its left end as viewed in FIGS. 1 and 20.

A base plate 10 is fixed to the main body 2 so as to correspond to the middle portion of the needle bar 1. As shown in FIG. 2, the upper and lower ends of the base plate 10 are bent backward to form an upper support part 10*a* and a lower support part 10*b*. A middle portion, formed as a left-hand side extension of the base plate 10 as viewed in FIG. 1, is bent backward in the same direction as upper and lower support parts 10*a* and 10*b* to form a middle support part 10*c*. The upper support part 10*a* and the lower support part 10*b* are provided with through holes for passing the needle bar 1 therethrough as shown in FIG. 1.

Figure 7:
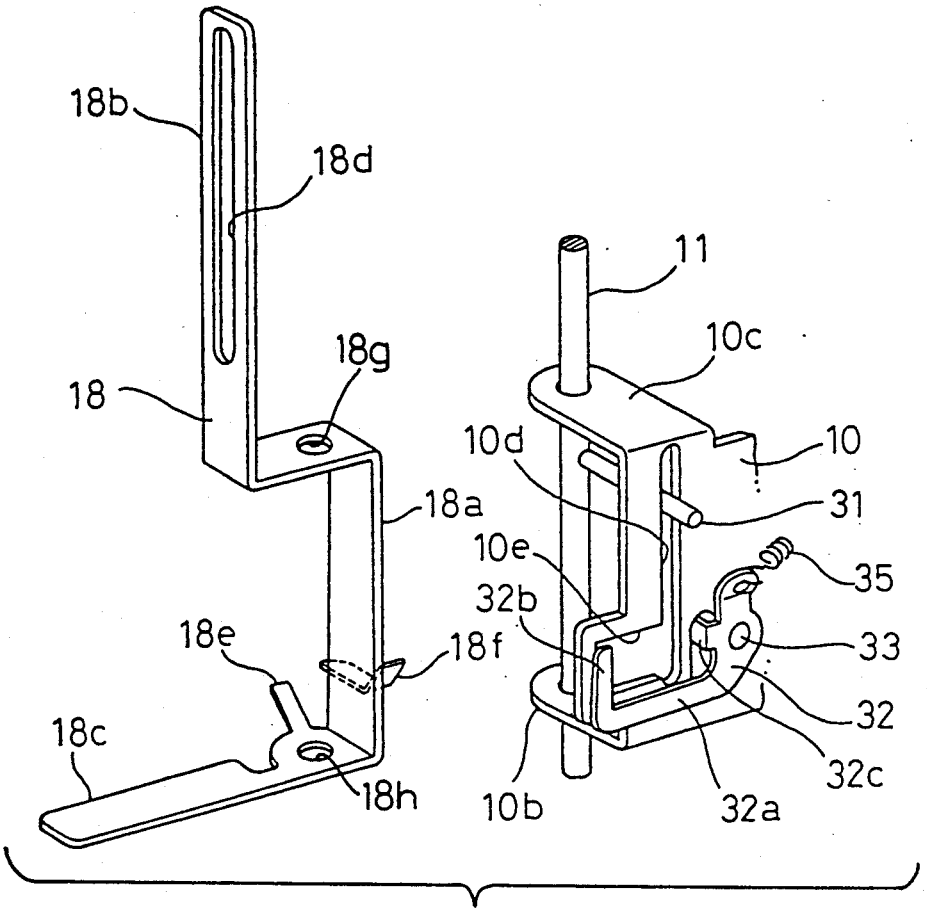
FIG. 7 is an exploded perspective view of a base plate, a lever and the associated parts.

A threading bar 11 is extended in parallel to the needle bar on the left side of the needle bar 1 as viewed in FIG. 1. As shown in FIG. 7, the threading bar 11 is extended through a through hole formed in the middle support part 10*c* and a through hole formed in the left-hand portion of the lower support part 10*b* of the base plate 10. As shown in FIGS. 1 and 2, a hook holding member 12 is attached to the lower end of the threading bar 11, and a positioning member 13 is attached to the upper end of the threading bar 11.

As shown in FIGS. 1 and 2, the positioning member 13 has a U-shaped section 13*a* through which the threading bar 11 extends, an upright section 13*b* extending upward from the upper rear end of the U-shaped section 13*a*, and a horizontal section 13*c* projecting to the right, as viewed in FIG. 1, from the lower rear end of the U-shaped section 13*a*. A coil spring 25 is extended between a projection 13*d* projecting from the front surface of the U-shaped section 13*a* of the positioning member 13 and a spring peg fixed to the support member 2*a* of the main body 2 to bias the threading bar 11 upward.

A slot 13*e* is formed in the upright section 13*b* of the positioning member 13, and a pin 14 projecting from the threading bar 11 is fitted in the slot. A positioning cam 15 is rotatably supported on the threading bar 11 so as to be disposed between the pin 14 and the U-shaped section 13*a*. A coil spring 17 is provided between the upper part of the U-shaped section 13*a* and a spring seat 16 fixed to the threading bar 11 to bias the positioning member 13 and the positioning cam 15 upward.

Figure 8:
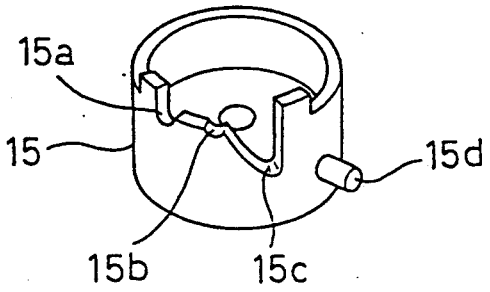
FIG. 8 is a perspective view of a positioning cam.

As shown in FIG. 8, the positioning cam 15 has an upper cylindrical wall provided in its upper end with three recesses 15*a*, 15*b* and 15*c* of different depths corresponding respectively to the positions of the needles 4, 5 and 6. A lever 18 is coupled to a portion of the threading bar 11 supported for turning on the base plate 10.

As shown in FIG. 7, the lever 18 has a substantially U-shaped base section 18*a*, an upright section 18*b* vertically extending upward from the upper end of the base section 18*a*, and an arm section 18*c* horizontally extending from the lower end of the base section 18*a*. Through holes 18*g* and 18*h* are formed in the upper and lower ends of the base section 18*a*, respectively, to receive the threading bar therethrough. The lever 18 is secured to the threading bar 11 so as to be disposed between the middle support part 10*c* and the lower support part 10*b* of the base plate 10.

A vertical slot 18*d* is formed in the upright section 18*b* of the lever 18, and a pin 15*d* projecting from the circumference of the positioning cam 15 is fitted in the slot 18*d*. The positioning cam 15 is turned by turning the lever 18 to receive the pin 14 in a desired one of the recesses 15*a*, 15*b* and 15*c*. The vertical position of the positioning member 13 relative to the threading bar 11 is changed by changing the position of the recesses 15*a*, 15*b* and 15*c* relative to the pin 14.

As shown in FIG. 7, a projection 18*e* projects backward from the side surface of the lower portion of the base section 18*a* of the lever 18, and a cam plate 18*f* projects from the base section 18*a* of the lever 18.

A threading hook member 20 is held on the hook holding member 12 as shown in FIG. 2. A threading hook holding arrangement will be described with reference to FIGS. 9 and 10. Referring to FIG. 10, the threading hook member 20 has a substantially L-shaped shank 20*a* and a hook 20*b* projecting normal from the front end of the shank 20*a*. The threading hook member 20 is held between two hook protecting members 21 and 22. The hook protecting members 21 and 22 have substantially L-shaped shanks 21*a* and 22*a*, and hook protectors 21*b* and 22*b* projecting toward the front from the front ends of the shanks 21*a* and 22*a*, respectively. The threading hook member and the hook protecting members 21 and 22 are joined together by securing a pin 23*a* in the right ends, as viewed in FIG. 10, of the shanks 20*a*, 21*a* and 22*a* thereof, such as by caulking, and by securing a pin 23*b* at the bends of the shanks 20*a*, 21*a* and 22*a* thereof.

A horizontal groove 12*a* is formed in the back surface of the hook holding member 12. The shanks 20*a*, 21*a* and 22*a* of the threading hook member 20 and the hook protecting members 21 and 22 are fitted slidably in the groove 12*a* of the hook holding member 12, and a cover 24 is screwed to the hook holding member 12 so as to cover the shanks 20*a*, 21*a* and 22*a* of the threading hook member 20 and the hook protecting members 21 and 22 by screws 25. The threading hook member 20 is slidable relative to the hook holding member 12 and hence relative to the threading bar 11. Alternatively, the cover 24 may include a horizontal groove for receiving the shanks 20*a*, 21*a* and 22*a* of the threading hook member 20 and the hook protecting members 21 and 22.

A slot 24*a* and a through hole 24*b* are formed respectively in the opposite ends of the cover 24. The pin 23*a* extends through the slot 24*a*. The shank 21*a* of the hook protecting member 21 is provided in its middle portion with positioning recesses 21*c* and 21*d*. A positioning ball 27 is fitted in the through hole 24*b* of the cover 24 and is pressed against the hook protecting member 21 with a flat spring 26, so that the ball 27 drops into either the recess 21*c* or 21*d* to position the threading hook member 20 relative to the hook holding member 12.

When the threading bar is turned, the hook holding member 12 turns together with the threading hook member 20 about the axis of the threading bar 11, so that the hook 20*b* of the threading hook member 20 advances into and retracts from the eye 4*a*, 5*a* or 6*a* of the needle 4, 5 or 6 as the threading bar 11 is turned in opposite directions.

Figure 9:
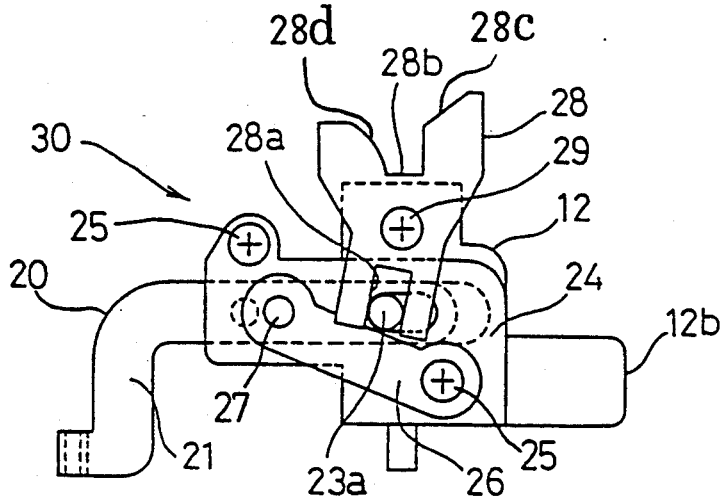
FIG. 9 is a back view of a threading hook member and the associated parts.
Figure 10:
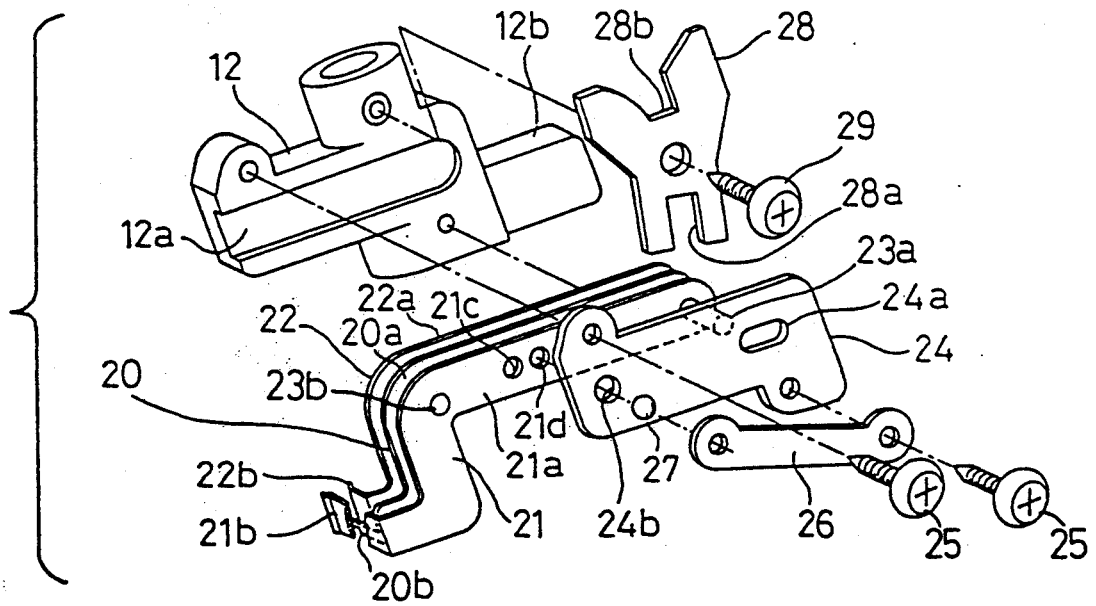
FIG. 10 is an exploded perspective view of the threading hook member and the associated parts.

As shown in FIG. 9, a lever 28 is held on the hook holding member 12 so as to be turnable on a stud screw 29. The pin 23*a* fixed to the threading hook member 20 is received in a recess 28*a* formed in the lower arm of the lever 28. The lever 28 is turned in one or the opposite direction to shift the threading hook member 20 to the right or to the left, as viewed in FIG. 10, to change the radius of a circular path along which the hook 20*b* moves. The projection 18*e* of the lever 18 is in engagement with a recess 28*b* formed in the upper arm of the lever 28. Recess 28*b* has a beveled edge 28*c* and a curved edge 28*d*, both sloping inwardly toward the recess. As seen in FIG. 9, beveled edge 28*c* extends higher than curved edge 28*d* in order to act as a stop for lever 18*c*. The hook holding member 12 is provided at its left end with a lug 12*b* projecting to the left, as viewed in FIG. 1.

Referring again to FIG. 1, a vertical slot 10*d* is formed near the left edge of the base plate 10. A pin 31 projecting to the front from the middle portion of the threading bar 11 is in engagement with the slot 10*d*. A rectangular hole 10*e*is formed in the lower left-hand corner of the base plate 10, and the slot 10*d* merges into the rectangular hole 10*e* . A turning range limiting member 32 is supported on the lower end of the base plate 10 by a pin 33.

Figure 11:
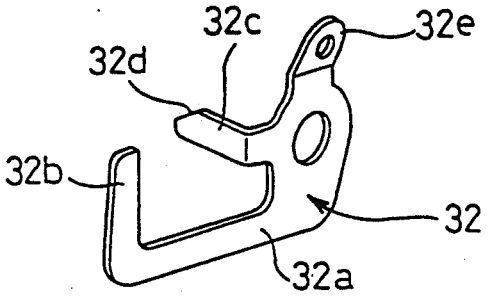
FIG. 11 is a perspective view of a turning range limiting member.

As shown in FIG. 11 the turning range limiting member 32 has an arm 32*a*, a finger 32*b* extending from the extremity of the arm 32*a* at right angles to the arm 32*a*, and a finger 32*c* projecting backward from the base end of the arm 32*a*. The extremity of the finger 32*c* is cut obliquely to form a slope 32*d*, which engages the cam plate 18*f* (FIG. 7) of the lever 18 as shown in FIG. 20. A coil spring 35 is extended between a hole 32*e* formed in the upper end of the turning range limiting member 32 and a spring peg 10*f* attached to the base plate 10 near the right edge of the same to bias the turning range limiting member 32 clockwise, as viewed in FIG. 1.

Threading operation of the threading device thus constructed will be described hereinafter with reference to FIGS. 12 to 20. For purposes of description, the threading operation shown in FIG. 12 has the needles 4 and 5 held on the needle holder 3 with the needle 4 to be threaded. A pulley, not shown, is rotated to position the needle bar 1 at a position in the range of the uppermost position and a position 3 mm below the uppermost position. The threading operation can be achieved with the needle bar 11 at such a position without being obstructed by the upper and lower loopers, not shown, and the edge trimmer, not shown.

Then, the lever 18 is turned to turn the positioning cam 15 so that the pin 14 of the threading bar 11 drops in the recess 15*a* to position the threading hook member 20 on a level corresponding to the needle 4. At the same time, the lever 28 is turned counterclockwise, as viewed in FIG. 15, by the projection 18*e* of the lever 18 to shift the pin 23 to the right (to the left as Viewed in FIG. 9) so that the ball 27 (FIG. 10) drops in the positioning recess 31*d* of the hook protecting member 21. Consequently, the radius of turning of the hook 20*b* of the threading hook member 20 is increased.

Figure 12:
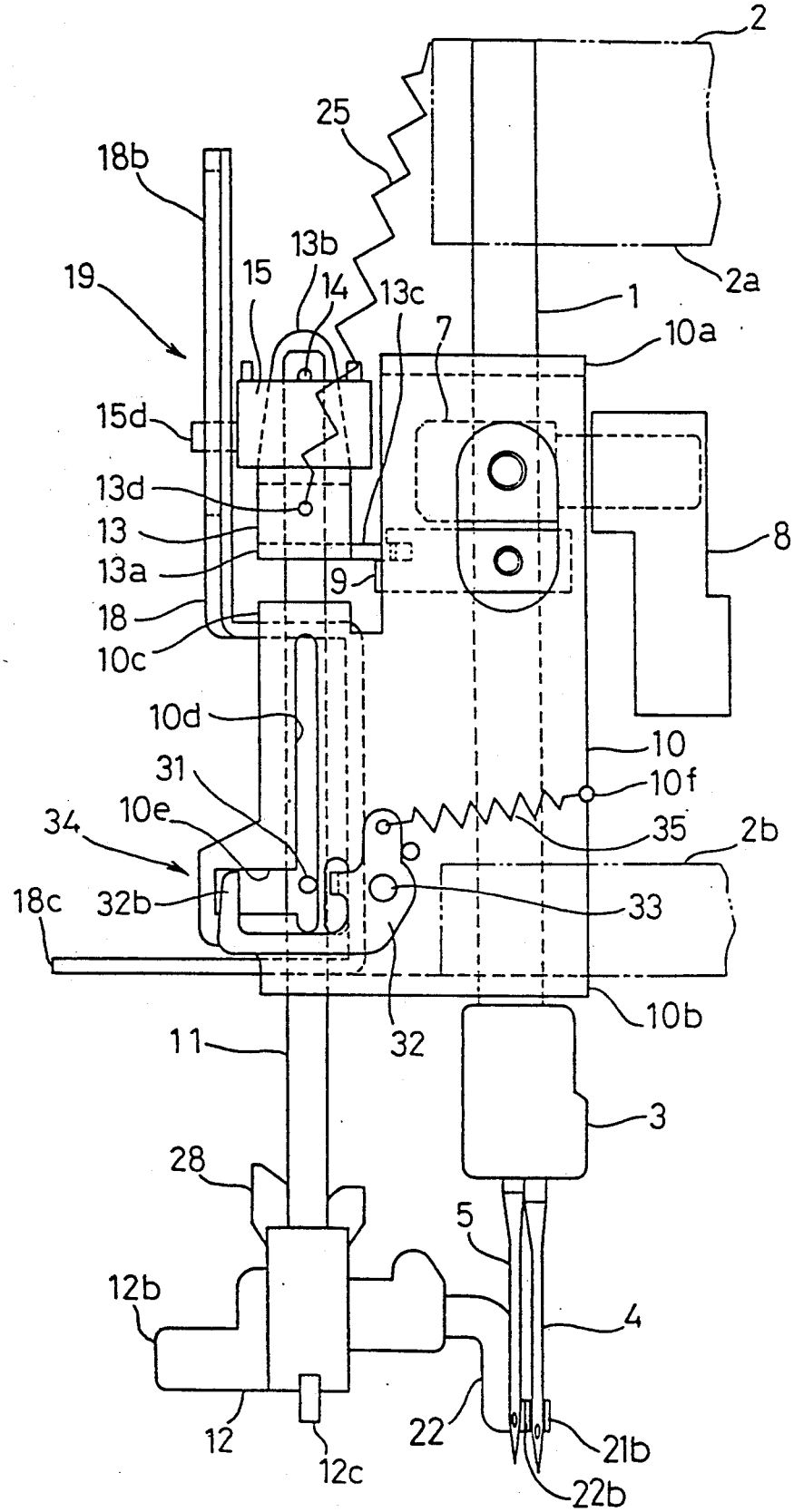
FIG. 12 is a partial front view, similar to FIG. 1, of the threading device, in which a threading bar is at its lower position.
Figure 13:
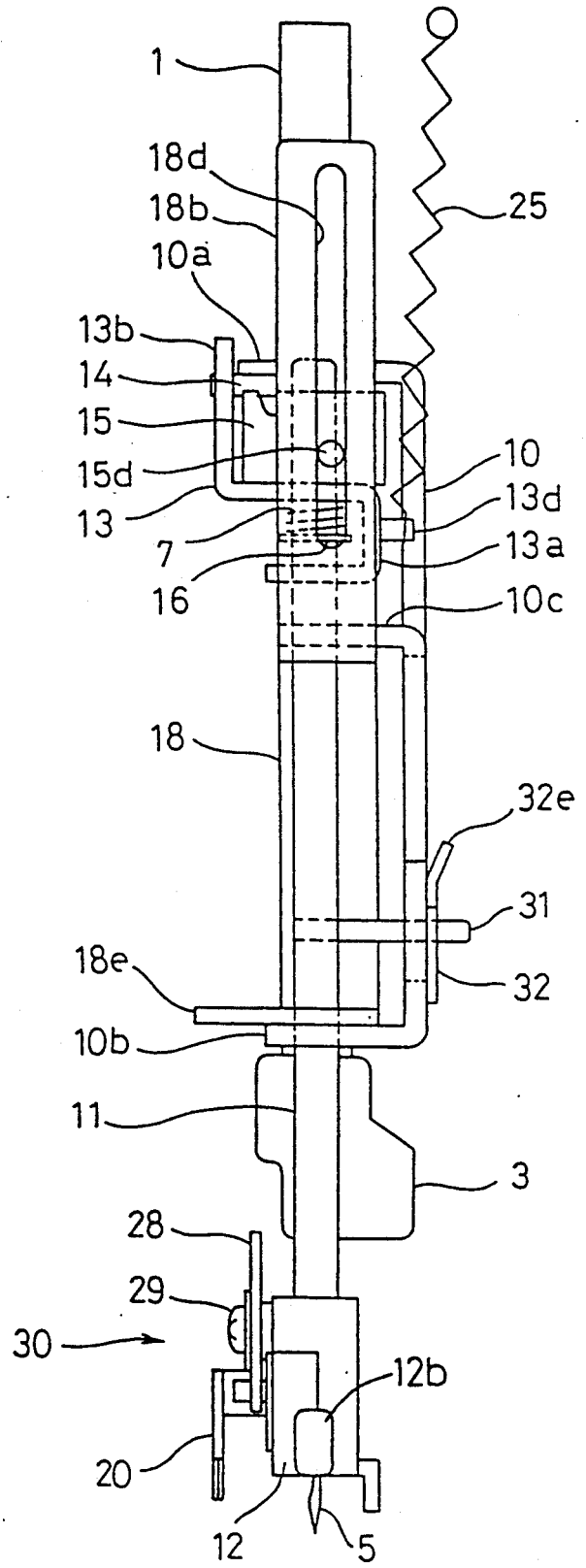
FIG. 13 is a side view, similar to FIG. 2, in which the threading bar is at its lower position.

Then, the lug 12*b* of the hook holding member 12 is depressed by hand to move the threading bar 11 downward. Then, as shown in FIGS. 12 and 13, the horizontal section 13*c* of the positioning member 13 comes into contact with the stopping part 9*a* (FIG. 6) of the stopping member 9 fixed to the needle bar 1 to limit the downward movement of the threading bar 11. Then, the lug 12*b* of the hook holding member 12 is pushed by hand to turn the threading bar 11 to turn the threading hook member 20 clockwise, as viewed in FIG. 14, to advance the hook 20*b* of the threading hook member 20 into the eye 4*a* of the needle 4.

Figure 14:
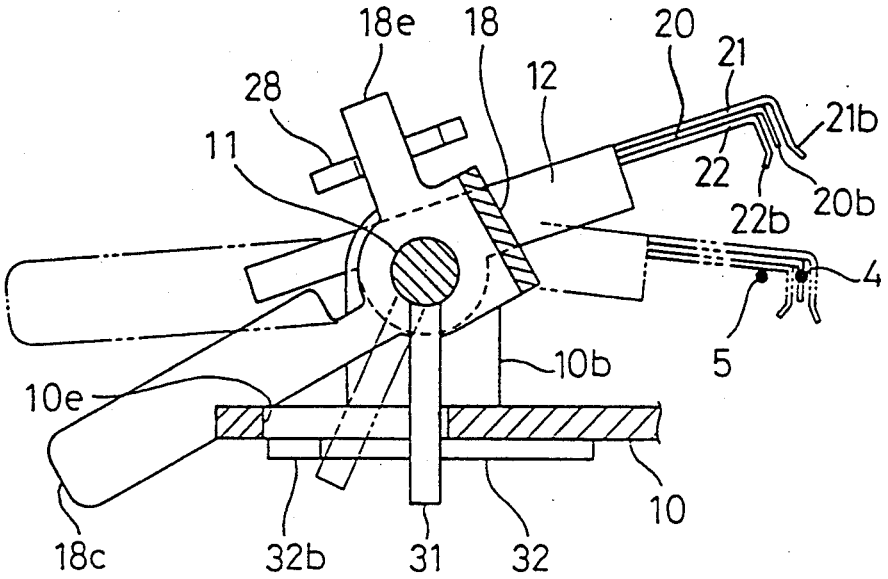
FIG. 14 is a cross-sectional view of the threading hook member and the associated parts threading needle 4.
Figure 15:
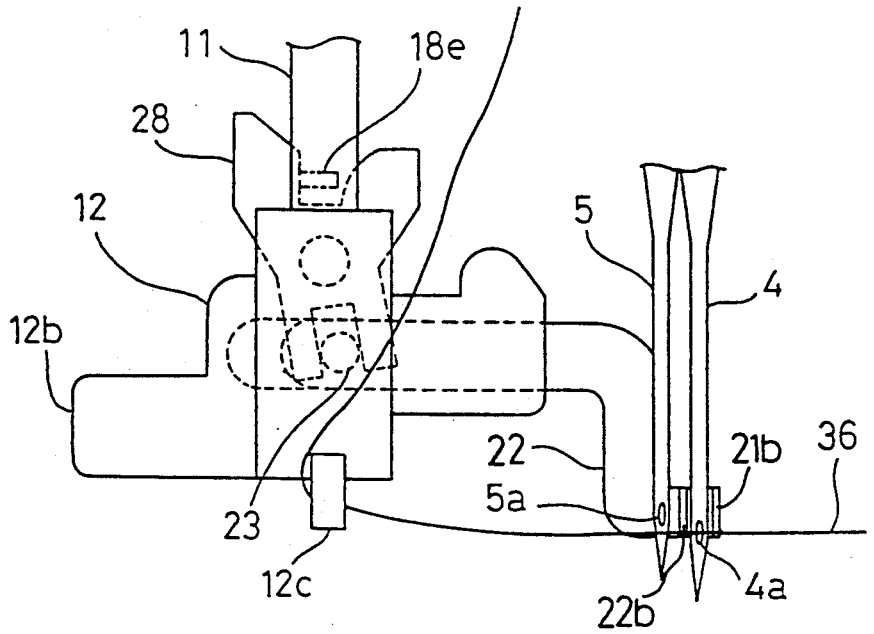
FIG. 15 is an enlarged partial front view of the threading hook member and the associated parts of FIG. 14.
Figure 21:
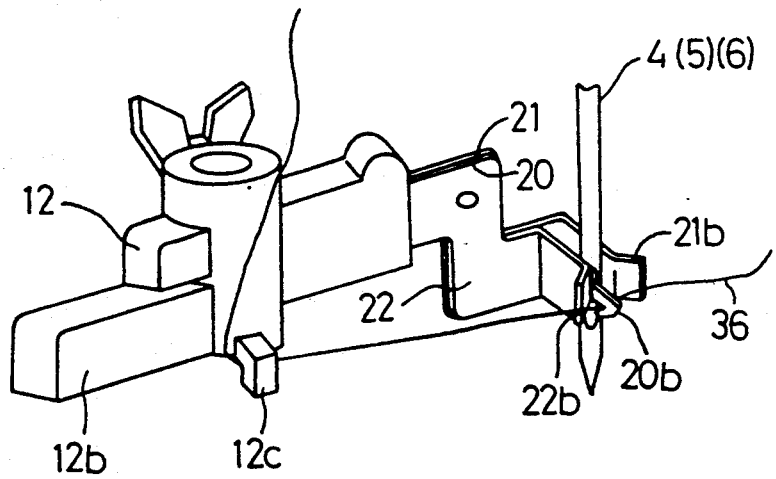
FIG. 21 is a perspective view of the threading hook member and associated parts showing the hook engaged with a thread.

Needle thread 36 unwound from a bobbin, not shown, is passed through a yarn guide 12*c* attached to the hook holding member 12 and is extended in front of the eye 4*a* so as to be hooked by the hook 20*b* as shown in FIGS. 15 and 21. Then, the threading hook member 20 is turned counterclockwise, as viewed in FIG. 14, to retract the hook 20*b* together with the needle thread 36 from the eye 4a of the needle 4, so that the needle thread 36 is passed through the eye 4a of the needle 4.

In advancing the hook 20b through the eye 4a of the needle 4, as shown in phantom in FIG. 14, by turning the threading hook member 20 clockwise, as viewed in FIG. 14, the clockwise turning of the threading bar is limited by the abutment between the pin 31 of the threading bar 11 and the finger 32b of the turning range limiting member 32 to avoid the collision of the shank 20a of the threading hook member 20 against the needle 4.

While the threading hook member 20 is turned for angular reciprocation to advance the hook 20b through and to retract the hook 20b from the eye 4a, the horizontal section 13c of the positioning member 13 fixed to the threading bar 11 moves within the groove 9b of the stopping member 9 (FIG. 6) attached to the needle bar 1. Accordingly, the threading bar 11 is unable to move vertically during the threading Operation. When the threading hook member 20 is turned counterclockwise to its initial position, the threading bar 11 is shifted upward by the resilience of the coil spring 25 to its initial position as shown in FIGS. 1 and 2.

In passing the needle thread 36 through the eye 5a of the needle 5 on the left side of the needle 4, the arm section 18c of the lever 18 is operated by hand to turn the lever 18 so that the pin 14 fixed to the threading bar 11 drops in the recess 15b of the positioning cam 15 to position the threading hook member 20 on a level corresponding to the needle 5. At the same time, the lever 28 is turned clockwise, as viewed in FIG. 17, by the projection 18e of the lever 18 to shift the pin 23 to the left (to the right as viewed in FIG. 9). Consequently, the ball 27 drops in the positioning recess 21c of the hook protecting member 21 to reduce the radius of turning of the threading hook member 20.

Figure 16:
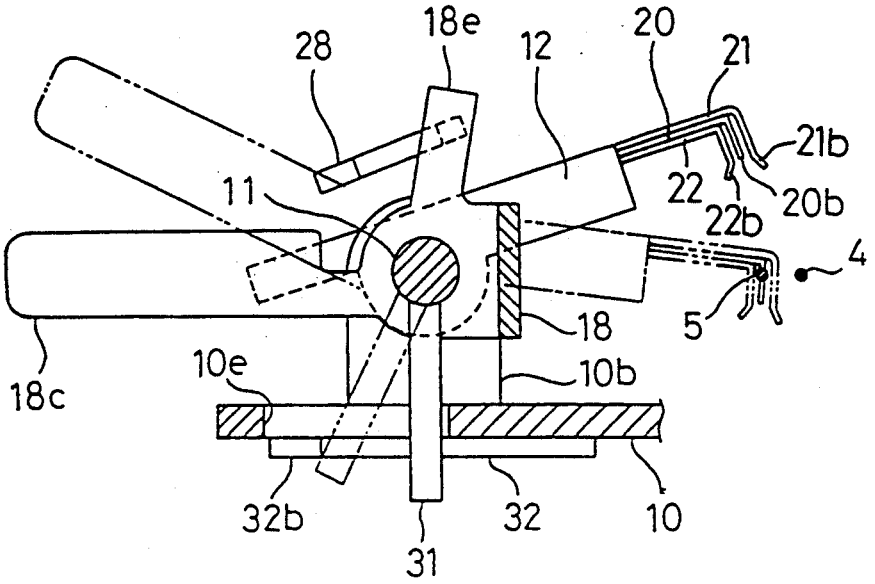
FIG. 16 is a cross-sectional view, similar to FIG. 14, of the threading hook member and the associated parts threading needle 5.
Figure 17:
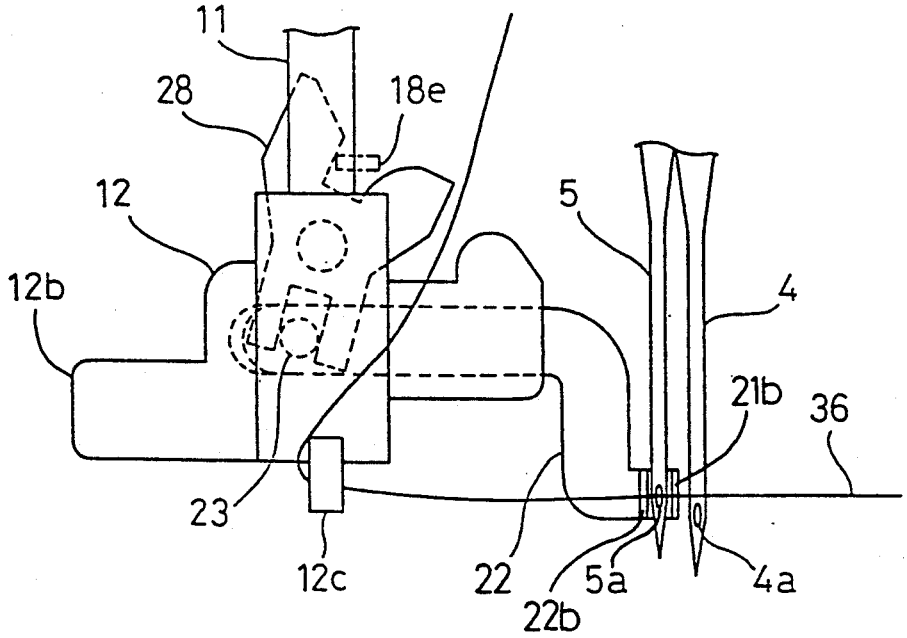
FIG. 17 is an enlarged partial front view similar to FIG. 15, of the threading hook member and the associated parts of FIG. 16.

Then, similarly to the threading operation for threading the needle 4, the hook holding member 12 is depressed at the lug 12b to shift the threading bar 11 downward to a position where the horizontal section 13c of the positioning member 13 and the stopping part 9a of the stopping member 9 abut each other. As shown in FIG. 16, the threading hook member 20 is turned clockwise, as viewed in FIG. 16, by operating the lug 12b of the holding member 12 by hand to advance the hook 20b of the threading hook member 20 through the eye 5a of the needle 5. Then, after hooking the needle thread 36 by the hook 20b of the threading hook member 20 as shown in FIG. 21, the threading bar 11 is turned in the reverse direction to pass the needle thread 36 through the eye 5a of the needle 5.

A manner of threading the needle 6 held by the needle holder 12 together with the needle 4 will be described hereinafter.

The arm section 18c of the lever 18 is operated by hand to turn the lever 18 so that the pin 14 of the threading bar 11 drops in the recess 15c of the positioning cam 15 (FIG. 8) to position the threading hook member 20 on a level corresponding to the needle 6. When the lever 18 is thus turned, the lever 28 is turned clockwise, as viewed in FIG. 19, by the projection 18e of the lever 18, so that the pin 23 is shifted to the left, as viewed in FIG. 19, (to the right as viewed in FIG. 9) and the ball 27 (FIG. 10) drops in the positioning recess 21c of the hook protecting member 21.

Consequently, the radius of turning of the threading hook member 20 is adjusted to the radius of turning of the threading hook member 20 for threading the needle 5, because the needles 5 and 6 are positioned on the same circular path along which the hook 21b of the threading hook member 20 moves as shown in FIG. 3. As shown in FIG. 20, the cam plate 18f of the lever 18 engages the slope 32d of the finger 32c of the turning range limiting member 32 to turn the turning range limiting member 32 on the pin 33 when the lever 18 is turned.

Figure 18:
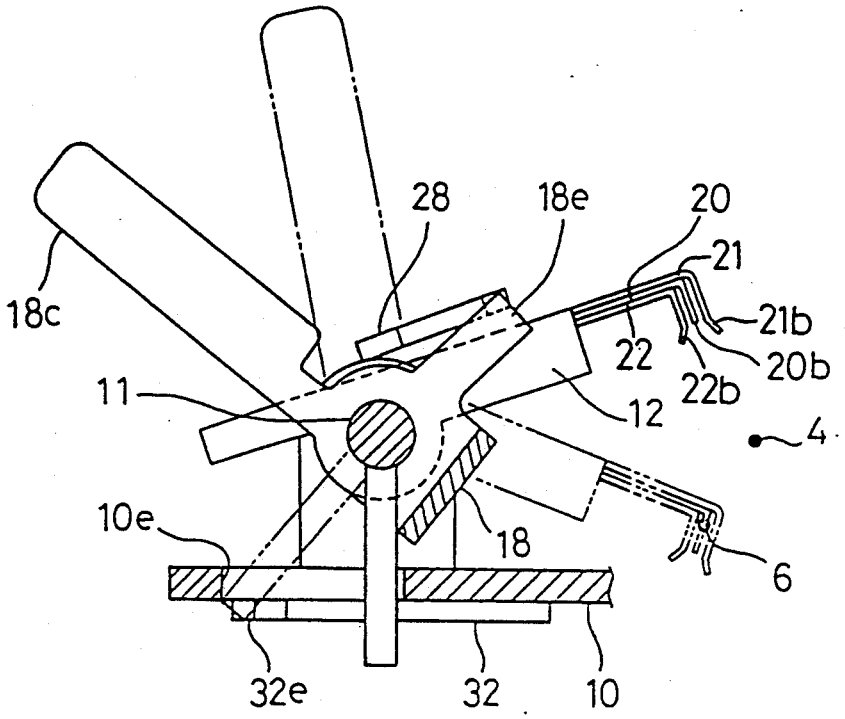
FIG. 18 is a cross-sectional view, similar to FIG. 14, of the threading hook member and the associated parts threading needle 6.
Figure 19:
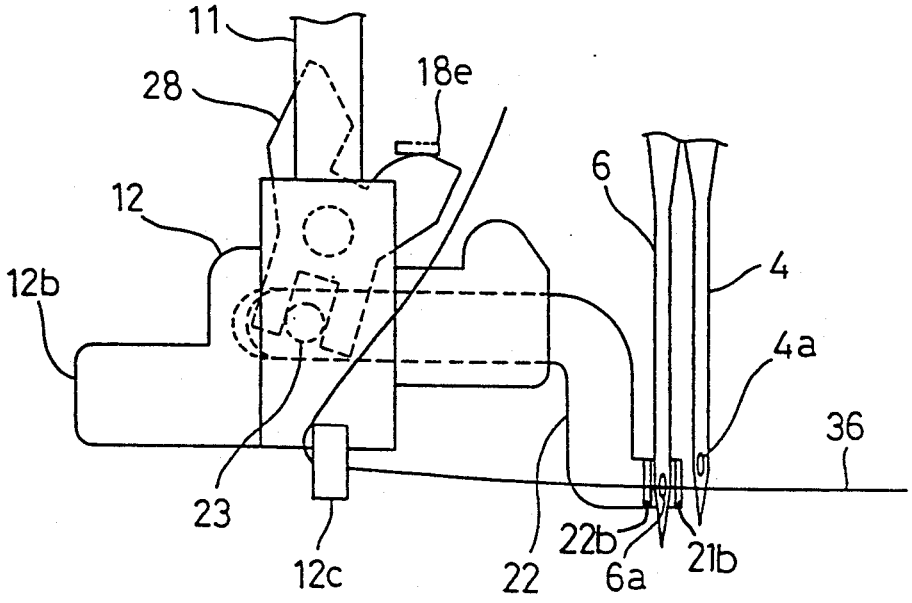
FIG. 19 is an enlarged partial front view, similar to FIG. 15, of the threading hook member and the associated parts of FIG. 18.

Then, the lug 12b of the hook holding member 12 is depressed to shift the threading bar 11 downward to a position where the horizontal section 13c of the positioning member 13 and the stopping part 9a of the stopping member 9 abut each other to position the threading bar 11. As shown in FIG. 18, the lug 12b of the hook holding member 12 is operated by hand so as to turn the threading hook member 20 clockwise, as viewed in FIG. 18, to advance the hook 20b of the threading hook member 20 through the eye 6a of the needle 6. Then, the foregoing threading operation is carried out to pass the needle thread 36 through the eye 6a of the needle 6.

As shown in FIG. 20, the cam plate 18f of the lever 18 turns the turning range limiting member 32 counterclockwise on the pin 33 when the threading hook member 20 is turned clockwise, as viewed in FIG. 18, so that the pin 31 of the threading bar 11 is separated from the finger 32b of the turning range limiting member 32. Therefore, the pin 31 is allowed to turn to the left end of the rectangular hole 10e of the base plate 10 to enable the threading bar 11 to turn to an angular position beyond an angular position corresponding to the needle 5. The turning of the pin 31 in the rectangular hole 10e is limited by the left end, as viewed in FIG. 20, of the rectangular hole 10e to avoid the collision of the threading hook member 20 against the needle 6.

In threading the lock stitch sewing machine by the threading device in this embodiment, the lever 18 of the level selecting means 19 is turned to select a level on which the threading hook member 20 is positioned for threading a desired one of the needles 4, 5 and 6, for example, the needle 4 (5, 6). Then, the threading hook member 20 is turned to advance the hook member 20b through the eye 4a (5a, 6a) of the desired needle 4 (5, 6). Thus, the needle 4 (5, 6) can be threaded simply by turning the threading hook member 20 in opposite directions, which is far simpler than the threading operation requiring a pincette or a threading attachment.

Since the threading hook member 20 is turned about the axis of the threading bar 11 supported in parallel to the needle bar 1, the radius of turning of the threading hook member 20 must be changed according to the respective positions of the needles 4, 5 and 6 to insert the hook 20b of the threading hook member 20 in either of the eyes 4a, 5a and 6a of the needles 4, 5 and 6 when the needles 4, 5 and 6 are arranged laterally.

According to the present invention, the radius of turning of the threading hook member 20 can selectively be determined by the radius selecting means 30 so that the threading hook member 20 corresponds to either of the needles 4, 5 and 6. Therefore, the threading device in this embodiment is able to thread the needles 4, 5 and 6 even if the same are arranged laterally.

The horizontal section 13c of the positioning member 13 is able to be in contact with the stopping part 9a of the stopping member 9 to position the threading hook member 20 relative to the needle bar 1 provided that the needle bar 1 is positioned at a position in the range of its uppermost position and a position about 3 mm below the uppermost position. Thus, the needle bar 1 can readily be positioned for threading because the needle bar 1 need not correctly be positioned at a fixed position for threading. Incidentally, the pulley must be turned through an angle on the order of 30° to move the needle bar 1 between the uppermost position and the position about 3 mm below the uppermost position, the needle bar 1 can be positioned for threading very easily as compared with positioning the needle bar 1 at a fixed position.

In threading either of the needles 4 and 5, the threading hook member 20 is turned toward the operator to insert the hook 20*b* of the threading hook member 20 in the eye 4*a* (5*a*) of the needle 4 (5), the turning of the threading bar 11, hence the threading hook member 20, is limited by the abutment between the pin 31 fixed to the threading bar 11 and the finger 32*b* of the turning range limiting member 32. Therefore, the collision of the threading hook member 20 against the needle 4 (5) can be avoided to surely prevent the breakage of the threading hook member 20.

As shown in FIG. 20, in threading the needle 6, the turning range limiting member 32 is turned so that the finger 32*b* of the turning range limiting member 32 escapes from the path of the pin 31 fixed to the threading bar 11 to enable the threading hook member 20 to be turned to a position where the hook 20*b* of the threading hook member 20 is inserted in the eye 6*a* of the needle 6 and the pin 31 fixed to the threading bar 11 is in contact with the left end of the rectangular hole 10*e* of the base plate 10. Accordingly, the collision of the threading hook member 20 against the needle 6 can surely be avoided.

Although the present invention has been described as applied to the three-needle lock stitch sewing machine, naturally, the present invention is applicable also to a two-needle lock stitch sewing machine.

What is claimed is:

1. A multineedle sewing machine provided with a plurality of needles and a threading device for threading the plurality of needles, comprising:

a needle bar supported for vertical reciprocation and provided at its lower end with a needle holding member holding a plurality of needles having eyes;

a threading bar supported for vertical movement substantially parallel to said needle bar;

a threading hook member provided with a hook, supported on said threading bar and rotatable about the axis of said threading bar so that the hook is advanced into and retracted from the eye of a selected one of the plurality of needles; and level selecting means rotatably supported on said threading bar for positioning said threading hook member selectively on a level corresponding to the selected needle depending on a rotation position of said level selecting means.

2. A multineedle sewing machine according to claim 1, further comprising radius selecting means for changing the radius of rotation of said threading hook member according to a position of the selected needle so that a position of said threading hook member corresponds to the position of the selected needle.

3. A multineedle sewing machine according to claim 2, wherein said radius selecting means comprises:

a threading hook holding member provided with a groove extending in a plane substantially parallel to the axis of the threading bar and coupled to said threading hook member;

a projection projecting from said threading hook member; and a radius selecting member pivotally coupled to said threading hook holding member and engaging said projection so as to shift said threading hook member in the groove of said threading hook holding member.

4. A multineedle sewing machine according to claim 1, further comprising turning range limiting means for limiting the rotation of said threading hook member to a position where the hook of said threading hook member is accurately inserted into the eye of the selected needle.

5. A multineedle sewing machine according to claim 1, wherein said level selecting means comprises:

a stopping member fixed to said needle bar;

a cam member having a cam surface provided with a plurality of recesses therein; and a positioning member for engaging the cam surface of said cam member, and for contact with said stopping member to position said threading hook member on a predetermined level corresponding to the selected needle when said threading bar is moved downward.

6. A multineedle sewing machine provided with a plurality of needles and a threading device for threading the plurality of needles, comprising:

a needle bar provided at its lower end with a needle holding member holding the plurality of needles having eyes;

a threading bar supported for vertical movement parallel to said needle bar;

a threading hook member provided with a hook and supported for rotation about the axis of said threading bar so that the hook is advanced into and retracted from the eye of a selected one of the plurality of needles;

a stopping member mounted on said needle bar;

a positioning member mounted on said threading bar for axial movement;

level changing means mounted on said threading bar for rotation said positioning member relative to said stopping member on a level corresponding to the selected needle; and radius changing means for changing the radius of rotation of said threading hook member according to the level on which said positioning member is positioned by said level changing means.

7. A multineedle sewing machine for use with a plurality of needles and having a threading device for threading the plurality of needles, comprising:

a needle bar for vertical reciprocation, having a needle holder for holding the plurality of needles;

a threading bar vertically mounted for movement parallel to said needle bar, having a hook holding member with a threading hook member;

vertical positioning means mounted on said threading bar for selectively positioning a vertical position of said threading hook member with respect to said plurality of needles; and radius selecting means mounted on said threading bar for selectively changing a radius of rotation of said threading hook member with respect to said threading bar.

8. A multineedle sewing machine according to claim 7, wherein said needle holder holds three needles, each needle having an eye disposed on a different level of the vertical position and the radius of rotation.

9. A multineedle sewing machine according to claim 7, wherein said needle holder holds first, second and third needles, the first and second needles being laterally aligned and the second and third needles being longitudinally aligned.

10. A multineedle sewing machine according to claim 7, wherein said threading bar is biased vertically upwardly with respect to said needle bar.

11. A multineedle sewing machine according to claim 7, wherein said vertical positioning means comprises a positioning member mounted for vertical movement on said threading bar and having a vertical slot;

a positioning cam mounted for rotatable and vertical movement on said threading bar with said positioning member, said cam having a plurality of recesses of different depths, each recess corresponding to a vertical position of a needle; and a pin coupled to said threading bar, slidably received in said vertical slot and selectively movable between said recesses in said positioning cam.

12. A multineedle sewing machine according to claim 11, further comprising a lever rotatably mounted on said threading bar and vertically slidably coupled to said positioning cam for rotating said positioning cam with respect to said threading bar.

13. A multineedle sewing machine according to claim 7, wherein said vertical positioning means comprises vertical stopping means including a stopping projection mounted for vertical movement on said threading bar and a stopping member mounted on said needle bar, said stopping projection engaging said stopping member for preventing vertical movement of said threading bar.

14. A multineedle sewing machine according to claim 7, further comprising turning range limiting means for limiting the turning range of the radius selecting means including a cam plate coupled to a lever rotatably mounted on said threading bar, and a turning range limiting member mounted on a base plate of the device for pivotal movement about a horizontal axis and comprising an arm having a obliquely cut finger, said finger engaging said cam plate upon rotation of said lever and limiting the turning range.

15. A multineedle sewing machine according to claim 7, wherein said radius selecting means comprises means for slidably mounting said threading hook member to said hook holding member; and a radius selecting lever pivotally coupled to said hook holding member and movable between a first and second position, said radius selecting lever being coupled to said threading hook member for selectively sliding said threading hook member.

16. A multineedle sewing machine according to claim 15, wherein said means for slidably mounting said threading hook member comprises a cover with a slot secured to said hook holding member, one of said cover and said hook holding member having a groove, said threading hook member being slidably received in said groove, and a pin secured to said threading hook member and extending through said slot, said radius selecting lever engaging said pin.

17. A multineedle sewing machine according to claim 16, wherein said radius selecting lever has a receiving slot on one end for engagement with said pin.

18. A multineedle sewing machine according to claim 15, wherein said radius selecting lever has an end slot with an inwardly sloping edge for engagement with a lever means for moving said radius selecting lever between said first and second positions.

19. A multineedle sewing machine according to claim 15, further comprising at least one hook protecting member coupled to said threading hook member, said hook protecting member having a pair of recesses, and a ball biased against said hook protecting member by a spring secured to a cover secured to said hook holding member, said ball being selectively received in one of said recesses for retaining said threading hook member in one of said first and second positions.

20. A multineedle sewing machine according to claim 7, wherein said vertical positioning means comprises:

a positioning member mounted for vertical movement on said threading bar;

a positioning cam mounted for rotatable and vertical movement on said threading bar above said positioning member, said positioning cam having a plurality of recesses of different depths;

a spring seat fixed to said threading bar;

a spring member provided between said positioning member and said spring seat for biasing said positioning member and said positioning cam upward; and a pin fixed to said threading bar above said positioning member and selectively movable between said recesses in said positioning cam for restricting upward movement of said positioning member through said positioning cam.

* * * * *